US005443370A

United States Patent [19]

Wang

[11] Patent Number: 5,443,370

[45] Date of Patent: Aug. 22, 1995

[54] TWO CYLINDER MANUAL AIR PUMP

[76] Inventor: Ro-Pin Wang, 5F, No. 1, Lane 85 Kwang Fu North Rd., Taipei City, Taiwan

[21] Appl. No.: 236,048

[22] Filed: May 2, 1994

[51] Int. Cl.[6] ..... F04B 27/08; F04B 33/00; F04B 39/10

[52] U.S. Cl. ..... 417/238; 417/469; 417/487; 417/526; 417/527; 417/547; 417/553; 92/59

[58] Field of Search ..... 417/238, 467, 468, 469, 417/553, 526, 527, 487, 547; 92/59, 117 A

[56] References Cited

U.S. PATENT DOCUMENTS

| | | | |
|---|---|---|---|
| 753,530 | 3/1904 | Eyck | 417/487 |
| 1,149,324 | 8/1915 | Stapley | 417/265 |
| 1,412,279 | 4/1922 | Eslinger | 417/547 |
| 3,302,535 | 2/1967 | Procter et al. | 92/52 |
| 4,508,490 | 4/1985 | Ramirez et al. | 417/238 |
| 5,051,073 | 9/1991 | Newbold | 417/526 |
| 5,165,876 | 11/1992 | Wang | 417/527 |

FOREIGN PATENT DOCUMENTS

| | | | |
|---|---|---|---|
| 0119586 | 7/1900 | Germany | 417/468 |
| 0696168 | 8/1953 | United Kingdom | 417/526 |

*Primary Examiner*—Richard A. Berisch
*Assistant Examiner*—Roland G. McAndrews, Jr.
*Attorney, Agent, or Firm*—Browdy and Neimark

[57] ABSTRACT

An air pump comprises a head; an air guiding tube fastened at one end thereof with the head and at another end thereof with a two-way air admitting piston; a first cylinder fitted over the two-way air admitting piston such that the first cylinder can be caused to move back and forth; a first one-way valve disposed in the anterior end of the first cylinder; a second piston disposed in another end of the first cylinder; a first one-way valve permitting air to enter only the first cylinder; a second cylinder fitted movably over the second piston; and a second one-way valve disposed in the second cylinder to permit air to enter only the second cylinder which is fastened with the first cylinder without being able to move in relation to the first cylinder.

6 Claims, 7 Drawing Sheets

TWO CYLINDER MANUAL AIR PUMP

FIELD OF THE INVENTION

The present invention relates generally to an air pump, and more particularly to an air pump capable of pumping the compressed air rapidly or of pumping the compressed air under a high pressure.

BACKGROUND OF THE INVENTION

It is a well-known fact that the pace of pumping the air into a tire is directly proportional to the inner diameter of the cylinder of an air pump. However, it is difficult to continue pumping the air into the tire with such an air pump as described above after the air pressure in the tire has reached a certain level. Such a difficulty can be overcome by making the inner diameter of the air pump cylinder smaller at the expense of the pace at which the air is pumped into the tire.

This inventor of the present invention discloses in the Taiwanese Patent Serial No. 79207439 a tire pumping device, which comprises an air guiding tube having one end that is fastened to the head of the pump. The head is provided with a connection head engageable with an air valve of the tire. Another end of the air guiding tube is fastened with a two-way air admitting piston to which a cylinder is pivoted. The cylinder is provided respectively at both ends thereof with a one-way air admitting valve. The air pumping action is carried out at a relatively fast pace by causing the cylinder to move back and forth.

Another improved air pump is disclosed by this inventor of the present invention in the Taiwanese Patent Serial No. 80210881. The air pump is provided with a second cylinder having one end fastened to the head of the pump and having an inner diameter greater than that of the first cylinder. One end of the first cylinder is received in the second cylinder and provided with a one-way pumping valve. The fastening end of the second cylinder is provided with a one-way valve. As the first cylinder is pushed into the second cylinder, the air inside the two cylinders is Compressed simultaneously and is then caused to move toward the head. The air pumping action is carried out at a rather fast pace by the first cylinder alone. However, the air pumping action can not be carried on further without difficulty after the tire pressure has reached a certain level.

SUMMARY OF THE INVENTION

It is therefore the primary objective of the present invention to provide an air pump with means capable of pumping the air into a tire at a fast pace initially and then at a slower pace after the tire pressure has reached a certain high level.

The foregoing objective of the present invention is attained by an air pump comprising a head, an air guiding tube, a two-way air admitting piston, a first cylinder, a first one-way valve, a second piston, a second cylinder, and a second one-way valve. The air guiding tube is fastened at one end thereof with the head and is fastened at another end thereof with the two-way air admitting piston. The first cylinder is fitted over the two-way air admitting piston such that the first cylinder can be caused to move back and forth. The first one-way valve is disposed in one end of the first cylinder contiguous to the head while the second piston is disposed in another end of the first cylinder. The first one-way valve permits the air to enter only the first cylinder while the second piston permits the air to move freely into or out of the first cylinder. The second cylinder is movably fitted over the second piston and is in communication with the first cylinder. The second one-way valve is so disposed in the second cylinder as to permit the air to enter only the second cylinder, which is fastened with the first cylinder without being able to move in relation to the first cylinder.

DETAILED DESCRIPTION OF THE INVENTION

Figure 1:
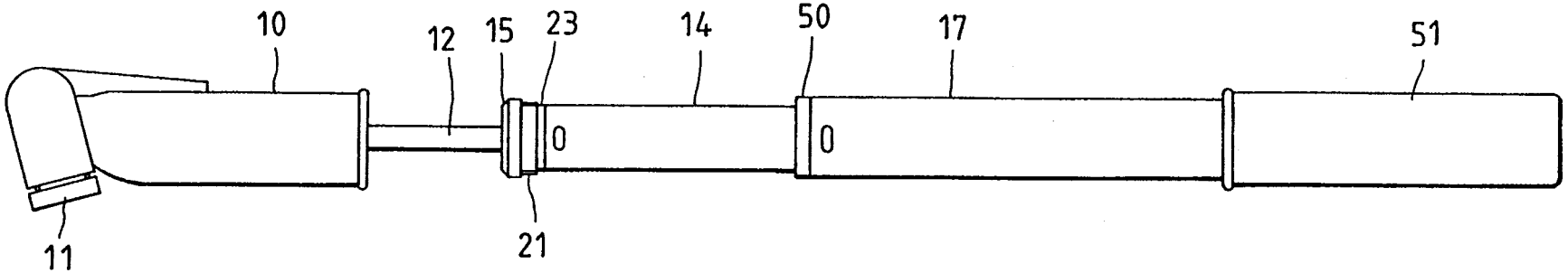
FIG. 1 shows a plan view of the present invention.
Figure 2:
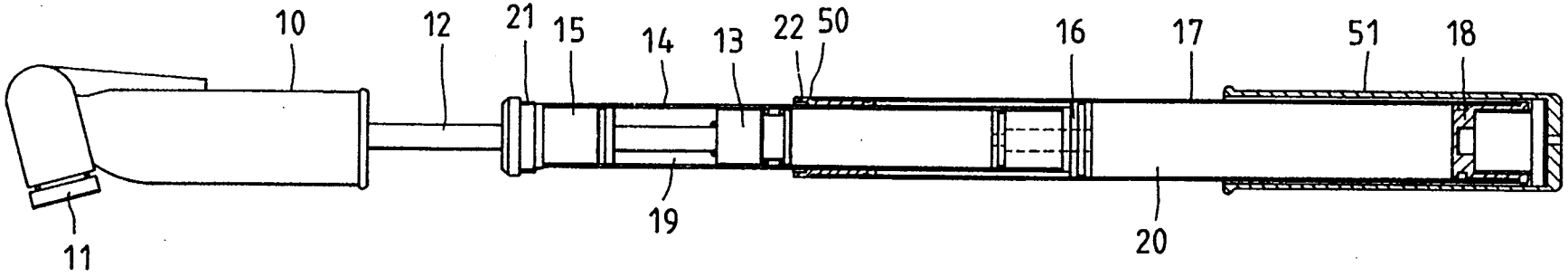
FIG. 2 shows a partial sectional view of the present invention as shown in FIG. 1.

As shown in FIGS. 1 and 2, an air pump embodied in the present invention is composed of the component parts, which are described hereinafter.

A head 10 is provided with a connection head 11 engageable with an air valve of the tire. The head 10 is of a construction similar to that of the head of the prior art air pump.

An air guiding tube 12 is fastened at one end thereof with the head 10.

A two-way air admitting piston 13 is fastened at another end of the air guiding tube 12 and is in communication with the connection head 11 of the head 10 via the air guiding tube 12.

A first cylinder 14 is tubular in construction and fitted over the two-way air admitting piston 13 such that the first cylinder 14 can be caused to move back and forth in the direction of the axis of the air guiding tube 12.

A first one-way valve 15 is disposed in one end of the first cylinder and contiguous to the head 10. The first one-way valve 15 permits the air to enter only the first cylinder 14.

A second piston 16 is disposed in another end of the first cylinder 14 and has an outer diameter greater than that of the first cylinder 14. The second piston 16 permits the air to move freely into and out of the first cylinder 14.

A second cylinder 17 has an inner diameter greater than that of the first cylinder 14 and is fitted over the second piston 16 such that the second cylinder 17 can be caused to move back and forth in the direction of the axis of the first cylinder 14. The second cylinder 17 is in communication with the first cylinder 14 via the second piston 16. The pivoting portion of the second cylinder 17 is sealed off by the second piston 16.

A second one-way valve 18 is disposed in the second cylinder 17 and permits the air to enter only the second cylinder 17.

The first cylinder 14 is provided therein with a first air chamber 19 located between the first one-way valve 15 and the two-way air admitting piston 13. A second air chamber 20 is formed between the interior space of the second cylinder 17 and the space located between the two-way air admitting piston 13 and the second one-way valve 18 of the first cylinder 14.

Figure 14:
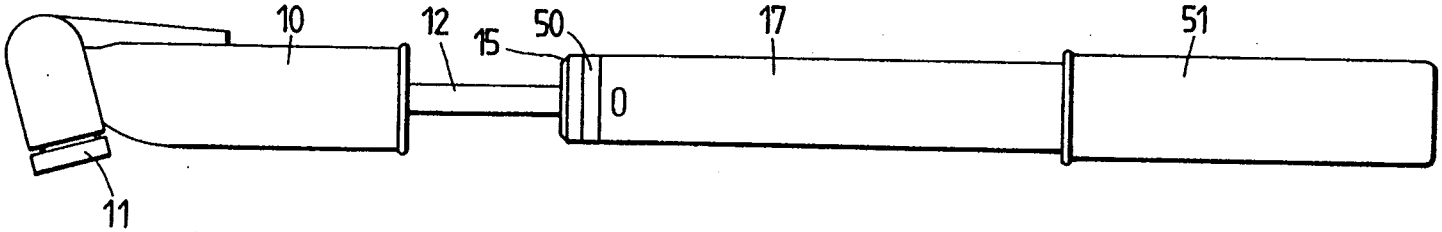
FIG. 14 is a plan view showing that the second cylinder is fastened securely with the first cylinder.
Figure 15:
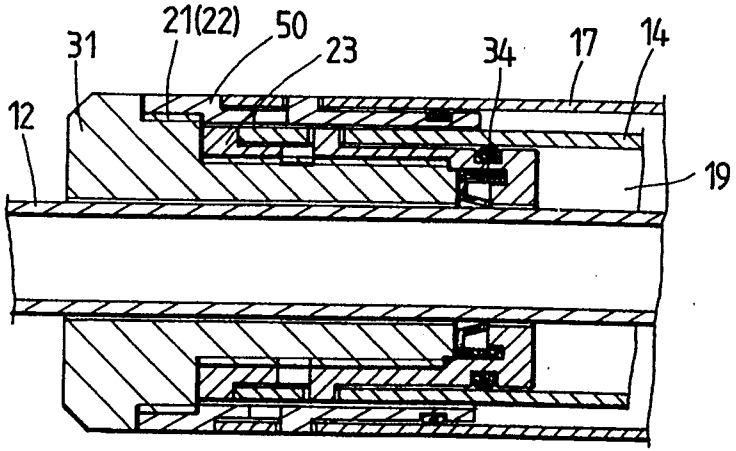
FIG. 15 is an enlarged partial sectional view of FIG. 14.

A connecting portion 21 is provided in the outside of the first one-way valve 15. The second cylinder 17 is provided in the anterior end thereof with a connecting portion 22 engageable with the connecting portion 21 so as to enable the second cylinder 17 to be located outside the first cylinder 14 without being movable in relation to the first cylinder 14, as shown in FIGS. 14 and 15.

Figure 3:
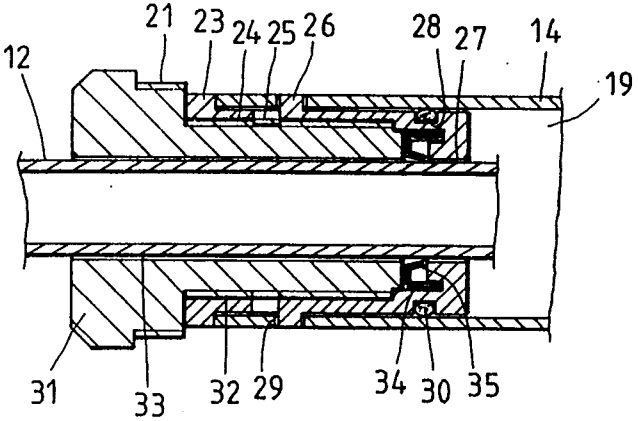
FIG. 3 shows an enlarged view of the first one-way valve as shown in FIG. 2.

As shown in FIG. 3, the one-way valve 15 comprises the component parts described hereinafter.

Figure 4:
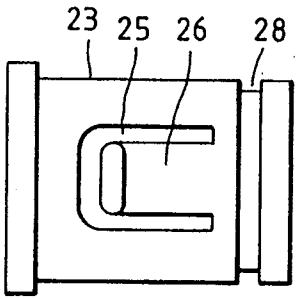
FIG. 4 shows a plan view of a seat of the first one-way valve as shown in FIG. 2.

A seat 23 of a cylindrical construction is provided in the inner wall thereof with female threads 24, as shown in FIG. 4. The cylindrical wall is provided relatively at 180 degrees with a U-shaped cut 25 having centrally an insertion portion 26. The cylindrical end wall is provided with a hole 27 dimensioned to receive therein the air guiding tube 12, and with an annular slot 28. The seat 23 is fastened with the anterior end of the first cylinder 14 by means of the two insertion portions 26 engageable with the two retaining holes 29 of the first cylinder 14.

A leakproof ring 30 is received in the annular slot 28 of the seat 23 to seal off the portion between the seat 23 and the wall of the first cylinder 14.

An end jacket 31 of a boltlike construction is provided with male threads 32 engageable with the female threads 24 of the seat 23 and is further provided centrally with a through hole 33 through which the air guiding tube 12 is disposed.

A one-way air admitting ring .34 is located between the seat 23 and the end jacket 31 and provided with an elastic lip 35 engageable with the wall of the air guiding tube 12 in an airtight manner.

Figure 5:
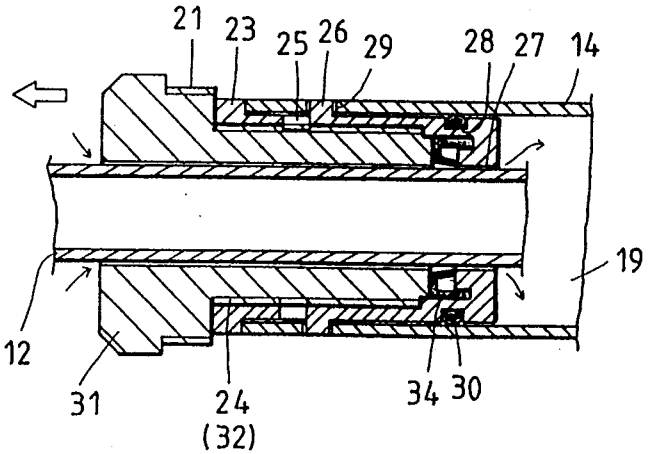

In operation, the space of the first air chamber 19 is expanded as a result of the movement of the first one-way valve 15 toward the head 10, as shown in FIG. 5. The atmospheric air is permitted to enter via tiny gaps located between the outer wall of the air guiding tube 12 and the inner walls of the through hole 33 and the hole 27. As a result of the difference in pressure, the elastic lip 35 of the one-way air admitting ring 34 is caused to deform to permit the air to enter the first air chamber 19.

Figure 6:
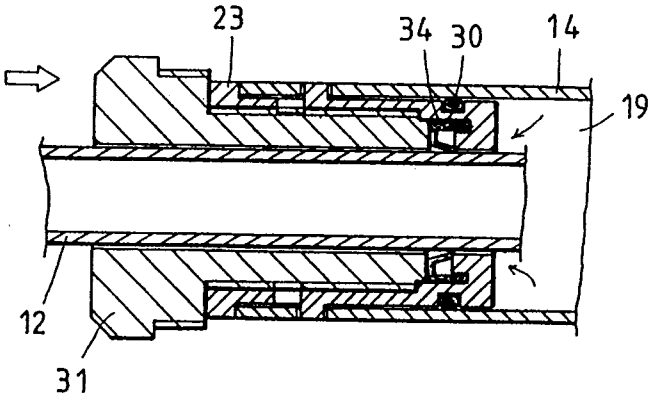
FIGS. 5 and 6 are schematic views illustrating the first one-way valve in action.

As shown in FIG. 6, when the first one-way valve 15 is caused to move to the right side of the drawing, the air in the first air chamber 19 is compressed. As the compressed air flows through the gaps between the hole 27 and the air guiding tube 12, the elastic lip 35 of the one-way air admitting ring 34 is caused to press against the wall of the air guiding tube 12 in an airtight manner. As a result, the air is permitted to flow only in one direction.

Figure 7:
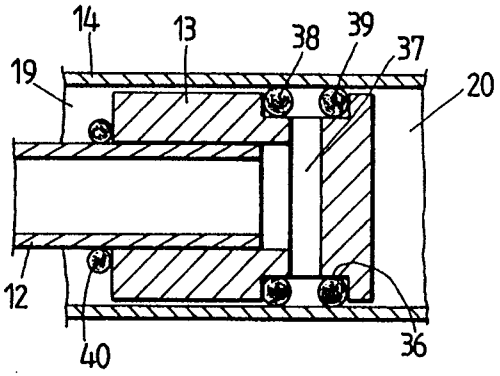
FIG. 7 shows an enlarged view of the two-way air admitting piston as shown in FIG. 2.

As shown in FIG. 7, the two-way air admitting piston 13 of a columnar construction is provided with an annular slot 36 having centrally a through hole 37 in communication with the air guiding tube 12. Two leakproof rings 38 and 39 are received in the annular slot 36. A cushion ring 40 is fitted over the air guiding tube 12 such that the cushion ring 40 is located at the end of the piston 13 for protecting the piston 113 from the impact force during the operation of the air pump.

Figure 8:
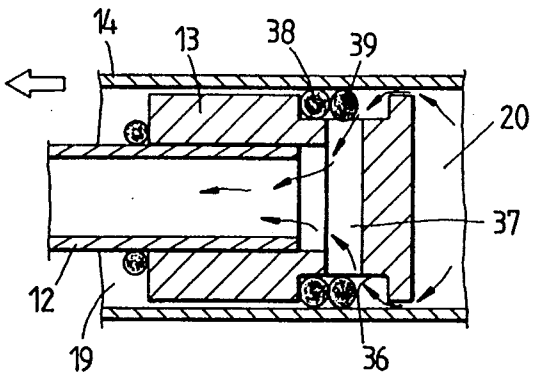
FIGS. 8 and 9 are schematic views showing the two-way air admitting piston at work.

As shown in FIG. 8, the second air chamber 20 is reduced in size when the first cylinder 14 is caused to move to the left, thereby resulting in an increase in the size of the first air chamber 19. Therefore, the leakproof rings 38 and 39 are forced to move to the left in the drawing, with the leakproof ring 38 sealing off the side wall of the annular slot 36 and the wall of the first cylinder 14. As a result, the first air chamber 19 is isolated from the second air chamber 20. The air in the second air chamber 20 flows into the air guiding tube 12 via the through hole 37.

Figure 9:
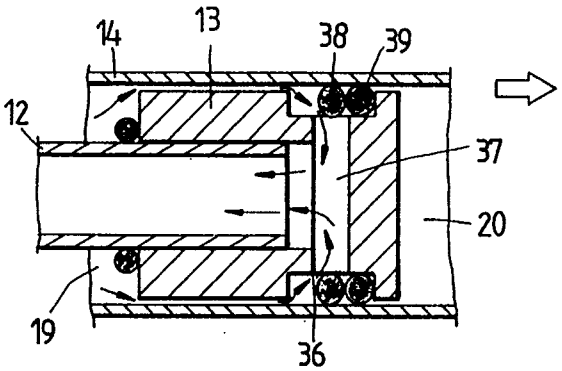

Now referring to FIG. 9, the cylinder 14 is shown moving to the right in the drawing so as to cause an increase in the size of the second air chamber 20 and a reduction in the size of the first air chamber 19. The leakproof rings 38 and 39 are therefore caused to move to the right in the drawing, with the leakproof ring 39 sealing off the side wall of the annular slot 36 and the wall of the first cylinder 14. The air in the first air chamber 19 flows into the air guiding tube 12 via the through hole 37.

Figure 10:
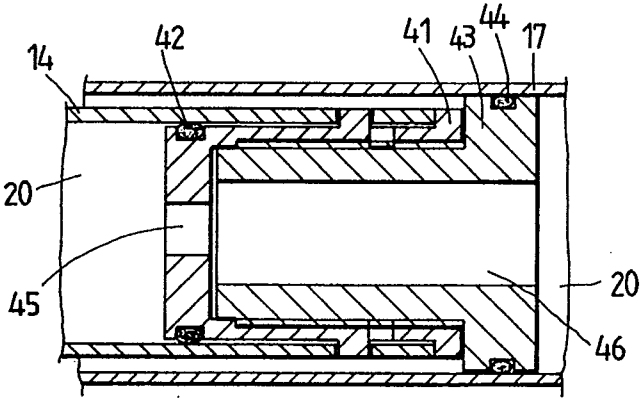
FIG. 10 shows an enlarged view of the second piston as shown in FIG. 2.

As shown in FIG. 10, the second piston 16 comprises the component parts described hereinafter.

A seat 41 has a shape similar to that of the seat 23 of the first one-way valve 15. The seat 41 is fastened to the posterior end of the first cylinder 14 for forming a connection portion at the open end of the first cylinder 14.

A leakproof ring 42 is fastened to the seat 41 such that the leakproof ring 42 seals off the space between the first cylinder 14 and the seat 41.

A plug 43 is fastened to the seat 41 for pivoting the second cylinder 17.

A leakproof ring 44 is fastened to the plug 43 so as to seal off the pivoting portion of the second cylinder 17.

These two members 41 and 43 are provided respectively with the through holes 45 and 46 for making the first and the second cylinders 14 and 17 to communicate with each other.

Figure 11:
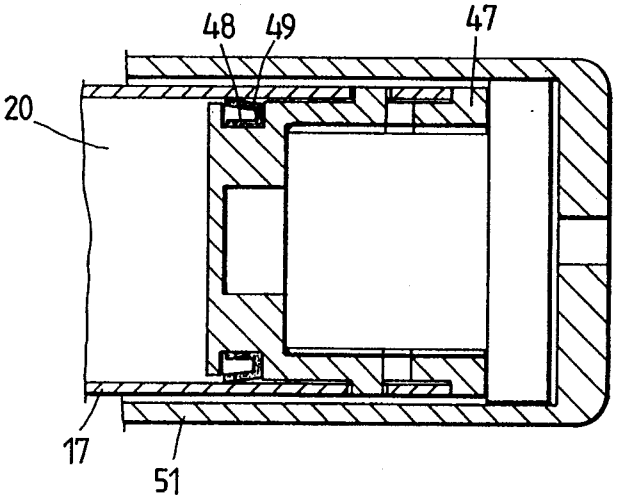
FIG. 11 shows an enlarged view of the second one-way valve as shown in FIG. 2.

As shown in FIG. 11, the second one-way valve 18 comprises the component parts described hereinafter.

A seat 47 is similar in shape to the seat 23, with the difference being that the seat 47 has an end wall devoid of the through hole. The seat 47 is fastened to the posterior end of the second cylinder 17 and provided in the inner wall thereof with a connection portion.

A one-way air admitting ring 48 is fastened to the seat 47 and provided with a lip 49 engageable with the wall of the second cylinder 17.

As the second air chamber 20 is caused to expand, the atmospheric air is permitted to enter via the gaps between the seat 47 and the cylinder wall, thereby bringing about the deformation of the lip 49 so as to permit the entry of the air into the second air chamber 20.

As the air in the second air chamber 20 is compressed, the pressure in the second air chamber 20 is therefore built up So as to force the lip 49 to attach airtightly to the cylinder wall.

Figure 13:
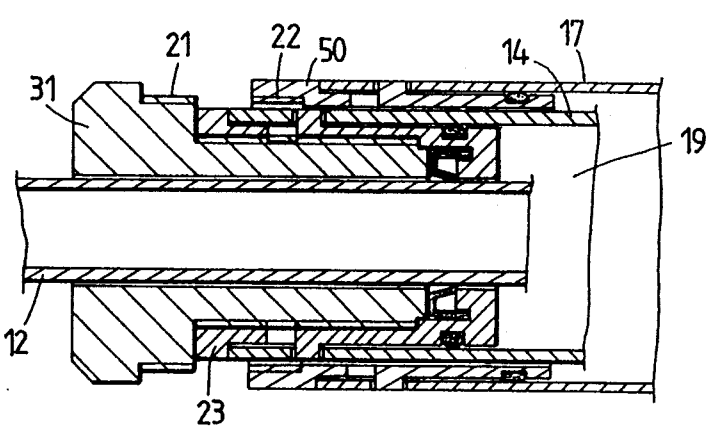
FIG. 13 is an enlarged partial sectional view of FIG.
Figure 12:
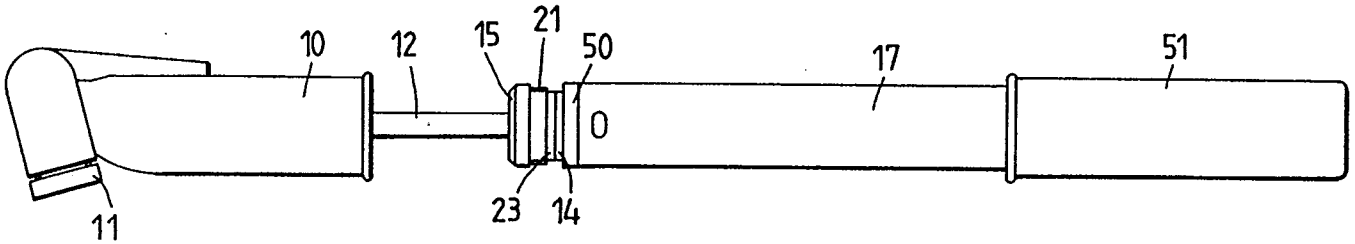
FIG. 12 is a plan view showing that the second cylinder is fitted over the first cylinder, without being fastened securely with the first cylinder.

As shown in FIGS. 12 and 13, a seat 50 is fastened to the anterior end of the second cylinder 17 and is similar in shape to the seat 23. The seat 50 is provided in the inner wall of the open end thereof with threads forming a connection portion 22 engageable with the connection portion 21 of the end jacket 31. The second cylinder 17 can be therefore fastened to the first cylinder 14 such that the second cylinder 17 can be caused to move simultaneously with the first cylinder 14, as shown in FIGS. 14 and 15.

Figure 16:
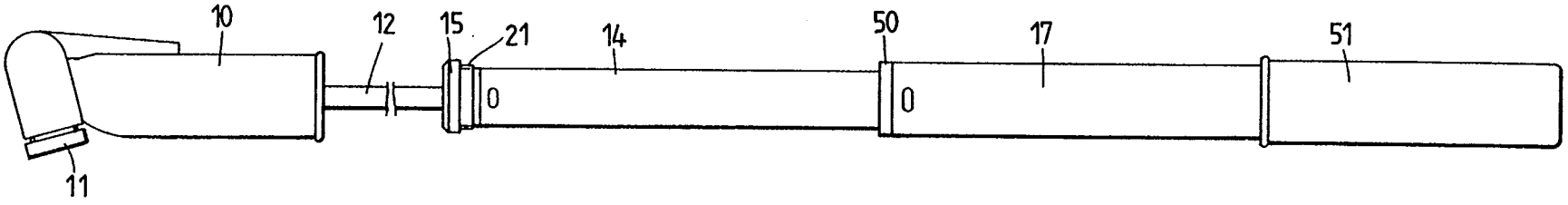
FIG. 16 is a plan view showing that the present invention is extended to a permissible extent.
Figure 17:
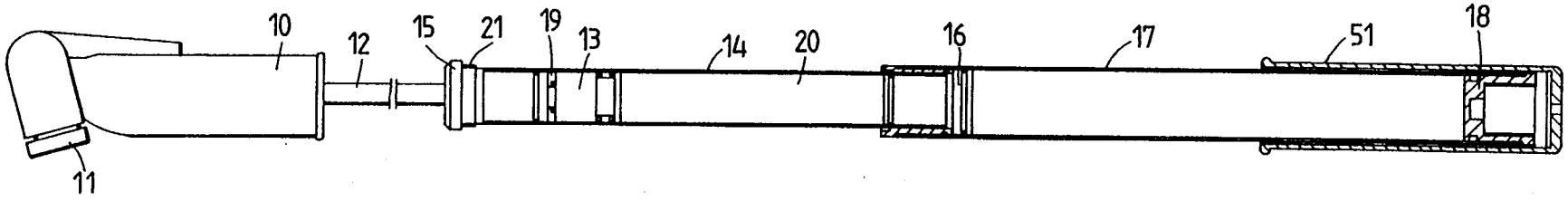
FIG. 17 is a sectional view of FIG. 16.

As shown in FIGS. 16 and 17, when the air pump is pulled to expand to a permissible extent, the space in the first air chamber 19 is reduced to a minimum while the space in the second air chamber 20 is increased to a maximum corresponding to the sum of volumes of the first cylinder 14 and the second cylinder 17.

In operation, the second air chamber 20 is caused to reduce in space when the handle 51 is pushed toward the head 10. The compressed air in the second air chamber 210 is caused to enter the air guiding tube 12 via the two-way air admitting piston 13. The compressed air is then caused to enter the tire air valve engaging the connection head 11. In the meantime, the space in the first air chamber 19 is so increased as to permit the entry of additional air via the first one-way air admitting valve 15.

Figure 18:
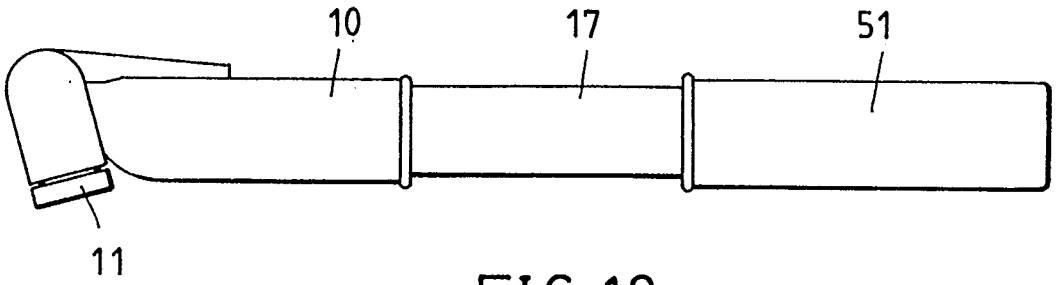
FIG. 18 is a plan view showing that the present invention is collapsed to a permissible extent.
Figure 19:
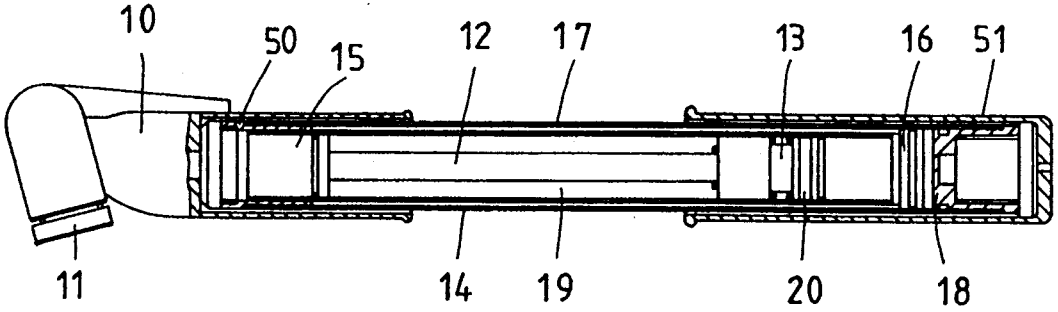
FIG. 19 is a sectional view of FIG. 18.

As shown in FIGS. 18 and 19, when the air pump is compressed to a permissible extent, the space in the second air chamber 20 is reduced to a minimum in contrast to the first air chamber 19 whose space is expanded to a maximum. As the handle 51 is pulled to the right in the drawing, the air in the first air chamber 19 is therefore compressed. The compressed air in the first air chamber 19 enters the air guiding tube 12 via the two-way air admitting piston 13. The compressed air is subsequently injected into the tire via the connection head 11 engaging the air valve of the tire. In the meantime, the space in the second air chamber 20 is increased in volume so as to permit the entry of additional air into the second air chamber 20 via the second one-way valve 18.

The compressed air can be pumped into a tire rapidly with the air pump of the present invention by virtue of the fact that the present invention is provided with the second air chamber 20 which is supplemented with the volume of the second cylinder 17.

As the air pressure of the tire is increased, the handle 51 of the present invention can not be pushed further easily. It is therefore suggested that the second cylinder 17 and the first cylinder 14 are so located securely, as shown in FIGS. 14 and 15, as to disable the second cylinder 17, thereby allowing only the first cylinder 14 to operate. The pumping is therefore made easier in view of the fact that the first cylinder 14 has a smaller inner diameter and that the two-way air admitting piston 13 has a smaller cross section.

What is claimed is:

1. An air pump comprising:

a head provided with a connection head engageable with an air valve of a tire;

an air guiding tube fastened at one end thereof with said head;

a two-way air admitting piston fastened to another end of said air guiding tube such that said two-way air admitting piston is in communication with said connection head;

a first cylinder tubular in shape and fitted over said two-way air admitting piston such that said first cylinder can be moved back and forth in the direction of the axis of said air guiding tube; and a first one-way valve disposed in an anterior end of said first cylinder, which is contiguous to said head, said first one-way valve being capable of permitting air to enter only said first cylinder;

wherein a second piston is disposed in a posterior end of said first cylinder, which is opposite to said anterior end of said first cylinder, said second piston having an outer diameter greater than that of said first cylinder and being capable of permitting air to move freely into and out of said first cylinder;

wherein a second cylinder is fitted pivotally over said second piston such that said second cylinder can be caused to move back and forth in the direction of the axis of said first cylinder, said second cylinder having an inner diameter greater than that of said first cylinder and communicating with said first cylinder via said second piston by which a pivoting portion of said second cylinder is sealed off in an airtight manner;

wherein a second one-way valve is disposed in a posterior end of said second cylinder such that said second one-way valve permits air to enter only said second cylinder; and wherein said first one-way valve is provided in an outer side thereof with a connection portion engageable with a connection portion located at an anterior end of said second cylinder so as to permit said second cylinder to be fastened with said first cylinder in such a manner that said second cylinder can not be caused to move in relation to said first cylinder.

2. The air pump according to claim 1 wherein each of said first cylinder and said second cylinder is tubular in shape and provided respectively with an open end in which a tubular seat body is lodged, said tubular seat bodies being provided with respective connection portions.

3. The air pump according to claim 1 wherein said first one-way valve comprises:

a seat body of a cylindrical construction and provided on an inner wall thereof with female threads, said seat body further provided in the wall thereof with an predetermined number of U-shaped cuts, leach of which is provided centrally with an insertion portion, said seat body further having a through hole dimensioned to receive therein said air guiding tube, said seat body further provided with an annular slot;

a leakproof ring received in said annular slot of said seat body for sealing off airtightly a space between said seat body and a wall of said first cylinder;

an end jacket having male threads engageable with said female threads of said seat body, said end jacket provided centrally with a through hole dimensioned to receive therein said air guiding tube; and a one-way air admitting ring disposed between said seat body and said end jacket and provided with an elastic lip capable of attaching to the outer wall of said air guiding tube in an airtight manner.

4. The air pump according to claim 1 wherein said second piston comprises:

a seat body tubular in shape and being fitted into a posterior end of said first cylinder, said seat body provided in the inner wall of said first cylinder with a connection portion;

a leakproof ring located between said seat body and the inner wall of said first cylinder;

a plug fastened at one end thereof with said connection portion of said seat body such that another end of said plug extends beyond the end of said first cylinder, said plug having an outer diameter greater than an inner diameter of said first cylinder, said another end of said plug being fitted into said second cylinder; and a leakproof ring fitted over said another end of said plug.

5. The air pump according to claim 1 wherein said second one-way valve comprises:

a seat body of a cylindrical construction and fastened to said posterior end of said second cylinder; and a one-way air admitting ring disposed between said seat body and said second cylinder and provided with an elastic lip capable of attaching to the inner wall surface of said second cylinder in an airtight fashion.

6. The air pump according to claim 1 wherein said second cylinder is provided in an anterior end thereof with a seat body of a tubular construction and having therein a connection portion engageable with said connection portion of said first one-way valve.

* * * * *